US006579813B1

(12) United States Patent
Kimura et al.

(10) Patent No.: US 6,579,813 B1
(45) Date of Patent: Jun. 17, 2003

(54) OIL APPLICATION APPARATUS

(75) Inventors: Kohichi Kimura, Hamamatsu (JP); Tatuo Takagi, Hamamatsu (JP); Shigeru Nakama, Hamamatsu (JP); Isami Abe, Hamamatsu (JP)

(73) Assignee: Nichias Corporation, Tokyo (JP)

( * ) Notice: Subject to any disclaimer, the term of this patent is extended or adjusted under 35 U.S.C. 154(b) by 85 days.

(21) Appl. No.: 09/610,483

(22) Filed: Jul. 5, 2000

(30) Foreign Application Priority Data

Jul. 5, 1999 (JP) ..... 11-190225

(51) Int. Cl.[7] ..... D04H 1/08

(52) U.S. Cl. ..... 442/320; 442/324; 428/308.4; 428/317.7; 118/60; 399/325

(58) Field of Search ..... 428/317.7, 308.4; 399/325; 442/320, 324; 118/60

(56) References Cited

U.S. PATENT DOCUMENTS

| | | | | |
|---|---|---|---|---|
| 4,757,347 A | * | 7/1988 | Tamaoki et al. | 219/216 |
| 5,636,012 A | | 6/1997 | Uneme et al. | |
| 5,674,020 A | | 10/1997 | Kimura et al. | |
| 5,732,317 A | | 3/1998 | Orchard, II et al. | |
| 5,779,795 A | | 7/1998 | Bucher et al. | |
| 5,853,832 A | | 12/1998 | Ishikawa | |
| 6,047,157 A | * | 4/2000 | Tatematsu et al. | 399/325 |
| 6,212,355 B1 | * | 4/2001 | Bunn et al. | 399/325 |
| 6,336,972 B1 | | 1/2002 | Kimura et al. | |

FOREIGN PATENT DOCUMENTS

| | | |
|---|---|---|
| EP | 0 783 143 A1 | 7/1997 |
| EP | 0 969 334 A2 | 1/2000 |
| GB | 2 285 768 | 7/1995 |
| JP | 9-108601 | 4/1997 |

OTHER PUBLICATIONS

Translation of JP– 07–160142, Jun. 23, 1995, Masahiko et al, 4 pages.*

* cited by examiner

*Primary Examiner*—Terrel Morris
*Assistant Examiner*—Hai Vo
(74) *Attorney, Agent, or Firm*—Nixon & Vanderhye P.C.

(57) ABSTRACT

An oil application apparatus comprising a porous oil-holding member, a heat-resisting fiber felt, and an oil application amount control layer. The porous oil-holding member is impregnated with silicone oil. The heat-resisting fiber felt has a bending resistance in the range of 30 to 90 mm and is provided on an oil application side of the porous oil-holding member. The oil application amount control layer is provided on the oil application side of the heat-resisting fiber felt.

14 Claims, 2 Drawing Sheets

OIL APPLICATION APPARATUS

BACKGROUND OF THE INVENTION

1. Field of the Invention

The present invention relates to an oil application apparatus which is one of constituent parts of a fixing apparatus in an electrostatic copying machine, an electrophotographic printer, or the like.

2. Description of the Related Art

In a fixing apparatus in an electrostatic copying machine, an electrophotographic printer, or the like, there was a possibility that toner transferred onto a sheet of recording paper was deposited on a heat-fixing roll when the toner was fixed. To prevent the next sheet of recording paper from being contaminated with the toner, a small amount of release oil such as silicone oil was applied onto the fixing roll by an oil application roller so that the toner was prevented from being deposited on the heat-fixing roll, and the recording paper was prevented from being curled up by sticking to the heat-fixing roll. Various application rollers having such a function have been already proposed. For example, there is known an oil application roller using a perforated hollow pipe of metal or a cylindrical molded product of heat-resisting fiber as an oil-holding member for storing release oil to be applied. The known oil application roller has an oil migration layer of heat-resisting felt provided on a surface of the cylindrical molded product, and an oil application amount control layer of a porous film further provided on the oil migration layer. Especially, JP-A-9-108601 discloses an oil-holding portion constituted by a porous cylindrical molded product. The porous cylindrical molded includes heat-resisting fibers bound together by a binder and fine communicating voids in the absence of the binder between the fibers. A group of pores is uniformly distributed in a pore size range of from 0.05 to 2 mm and has a total void percentage of from 30 to 90% The oil application roller using the porous cylindrical molded product is convenient in that the oil-holding member can hold a large amount of silicone oil and in that the large amount of silicone oil can be used for stable oil application over a long term.

When the oil application roller is used in a fixing apparatus in a color copying machine or color printer, there is, however, a tendency that the amount of application of oil becomes excessive for a time when the number of sheets passes through the copying machine or printer is from hundreds of sheets to thousands of sheets after the beginning of use because oil having a relatively low viscosity of from 50 to 100 cSt is used under the necessity of applying a great amount of oil onto the fixing roll compared with a monochromatic copying machine or monochromatic printer. For the same reason, the amount of leaking oil increases also while machine is stopped. There is still a problem that an excessive amount of silicone oil is applied onto the fixing roll for a short time just after the re-start of the paper-passing operation.

Further, when copying or printing is made on plastic sheets of OHP sheet, fixation of toner is affected even by slight irregularity of application of oil so that density irregularity is apt to occur in a fixed image easily. Particularly in the case of the oil migration layer formed by winding tape-like felt spirally without any gap, there is a slight bump in an abutting portion between end surfaces of the tape-like felt though the surface of the oil migration layer looks flat. Because the bump is extended spirally, the bump causes stripe-like irregularity of application of oil and, accordingly, causes density irregularity of a fixed image.

In order to solve this problem, there is a method in which an elastic layer is further provided between the oil application amount control layer and the oil migration layer so that a buffering function based on the elastic deformability of the elastic layer prevents a phenomenon that contact pressure between the oil application roller and the fixing roller is changed by the unevenness of the felt layer as the oil migration layer to thereby cause the aforementioned irregularity of application of oil and irregularity of fixing of an image. The method is, however, complex in production because of the necessity of forming the two layers, that is, the felt layer formed by spirally winding tape-like felt and the elastic layer. Hence, there is a problem that the production cost increases.

Further, in the background-art oil application roller, for example, having an oil migration layer or an elastic layer provided to a cylindrical or pad-like molded product, and an oil application amount control layer further bonded thereto, the oil application amount control layer is displaced or peeled because of shortage of adhesive strength due to the small adhesive area. Hence, there is a further problem that it is difficult to apply release oil on the fixing roll continuously and stably.

SUMMARY OF THE INVENTION

In view of the foregoing, an object of the present invention is to provide an oil application apparatus which has such a simple structure as to be produced easily, which can apply a proper amount of low-viscosity silicone oil just after the beginning of use while the amount of wasteful leaking oil during use is so small that there is no risk of application of excessive oil just after the re-start of the paper-passing operation and which can perform such uniform oil application that density irregularity does not occur in a fixed image even in the case where a subject of copying or printing is OHP sheets.

Another object of the present invention is to provide an oil application apparatus in which an oil application amount control layer is not displaced or peeled when the apparatus operates and in which the oil application amount control layer can be bonded to an oil-holding member easily.

Upon such circumstances, the inventors of the present invention have made examination eagerly. As a result, it has been found that, when the oil migration layer provided between the porous oil-holding member and the oil application amount control layer is constituted by one or two layers of heat-resisting fiber felt having a specific bending resistance, there is no necessity of providing two different kinds of felt-like materials or an elastic layer as a measure against irregularity of application of oil and irregularity of density of a fixed image so that a simple structure to be produced easily can be provided to thereby make it possible to reduce cost and make it possible to perform very uniform oil application without density irregularity of the fixed image even in the case where a subject of copying or printing is OHP paper. Hence, the present invention has been accomplished.

That is, the present invention provides an oil application apparatus characterized in that a porous oil-holding member is impregnated with silicone oil, and heat-resisting fiber felt having a bending resistance in the range of 30 to 90 mm is provided on an oil application side of the porous oil-holding member, and an oil application amount control layer is further provided on the oil application side of the heat-resisting fiber felt.

DETAILED DESCRIPTION OF THE PREFERRED EMBODIMENTS

Figure 1:
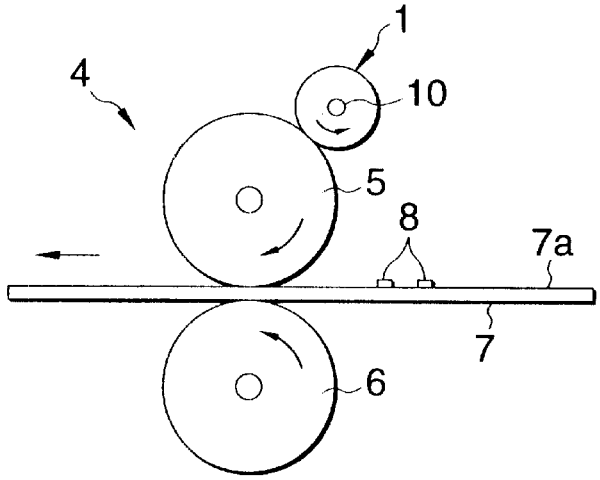
FIG. 1 is a side view showing a state of setting of an oil application roller in a fixing apparatus according to a mode for carrying out the present invention.

For example, the same material as described in JP-A-9-108601 is used as a porous oil-holding member used in an oil application apparatus according to the present invention. The oil-holding member has a group of pores which has such a large capacity that a great amount of silicone oil is held in the group of pores. The held silicone oil migrates to a heat-resisting fiber felt layer by capillarity via fine inter-fiber voids. Then, the silicone oil permeates through an oil application amount control layer of a porous film. Finally, the silicone oil seeps out to a surface of the oil application amount control layer. Silicone oil having a low viscosity in the range of 50 to 1,000 cSt, preferably in the range of 50 to 300 cSt at 25° C. is generally used as the silicone oil held by the porous oil-holding member.

The oil application amount control layer located as the outermost layer is made of a porous film. The oil application mount control layer stabilizes the amount of application of silicone oil into a suitable state. For example, a porous film having a thickness in the range of 15 to 130 $\mu$m, a mean pore size in the range of 0.05 to 3.0 $\mu$m, a porosity in the range of 60 to 90% and a gas permeability in the range of 3 to 1,500 seconds per 100 cc is preferably used as the oil application amount control layer. When the oil application amount control layer is bonded to the heat-resisting fiber felt by a mixture of an adhesive agent and silicone rubber, the preferred is a porous film having a thickness in the range of 15 to 130 $\mu$m and a mean pore size in the range of 0.05 to 3.0 $\mu$m and having a gas permeability in the range of 10,000 to 3,000,000 seconds per 100 cc in the condition that the oil application amount control layer is bonded to the heat-resisting fiber felt, as will be described later. When, for example, a PTFE (polytetrafluoroethylene) film is bonded by a mixture of silicone varnish and silicone rubber, bonding is performed uniformly on the whole adhesive surface. Hence, a predetermined percentage of pores in the PTEE film, which is a porous film, are filled with silicone varnish, so that the gas permeability of the porous film becomes large. Therefore, the percentage of pores filled with the adhesive agent, that is, the gas permeability of the porous film can be controlled on the basis of the mixture ratio of silicone varnish to silicone oil. If the gas permeability is in the aforementioned range when the oil application apparatus is used, good oil application performance is obtained. The gas permeability exhibits a value in the range regardless of the kind of the adhesive agent and the adhering method. The preferred material of the porous film is PTFE. With respect to the oil application amount control layer, the problem upon application of excessive oil at the beginning of use and at the start of the operation is improved remarkably by cooperation of the aforementioned low-viscosity silicone oil and heat-resisting fiber felt having a specific bending resistance which will be described later. Moreover, a rather great amount of oil than the amount of oil without the provision of the porous film is applied, so that very stable oil application is performed. The "gas permeability" is expressed in Gurley number (unit: second per 100 cc) measured by a B-type Gurley densometer. When the porous film is bonded by a mixture of an adhesive agent and silicone rubber, the gas permeability is measured in the condition that oil is diluted with toluene from a surface of the oil application amount control layer coated with oil so that only the adhesive agent is made to remain. The "porosity" is a value calculated on the basis of measured values of specific gravity by the following formula:

$$\text{porosity}(\%)=(1-\text{bulk specific gravity}/\text{true specific gravity})\times 100.$$

Although the heat-resisting fiber felt having a bending resistance in the range of 30 to 90 mm as used in the oil application apparatus according to the present invention is not particularly limited, for example, heat-resisting aramid fiber felt may be used. This is available as tradename "NOMEX" (made by Nippon Felt Industrial Co., Ltd.), etc. The bending resistance generally shows the degree of resistance against bending strength of a textile, or the like. The bending resistance is a value calculated by a "cantilever method" which is a method A for "bending resistance" defined in JIS L 1096. The bending resistance of the heat-resisting fiber felt is proportional to the density of the felt and inversely proportional to the pore size of the felt. Hence, as the value of the bending resistance increases, the felt becomes so dense and the pore size becomes so small that the felt is provided as so-called hard felt. As the value of the bending resistance decreases, the felt becomes so sparse and the pore size becomes so large that the felt is provided as so-called soft felt. On the other hand, both function of sucking a proper amount of silicone oil to be held by the oil holding member and flexible function of preventing irregularity of application of oil are required of the heat-resisting fiber felt which is an oil migration layer in the present invention. From the point of view of the function of sucking silicone oil, hard felt high in felt density is needed because the felt needs to have finer inter-fiber voids than the voids of the porous material of the oil holding member so that suction of an always proper amount of silicone oil is achieved by capillarity. From the point of view of the flexibility of preventing irregularity of application of oil, predetermined softness is needed because oil irregularity occurs when the heat-resisting fiber felt is too hard. That is, the bending resistance in the range of 30 to 90 mm satisfies antithetic requirements upon the function of sucking silicone oil and the flexibility of preventing irregularity of application of oil, simultaneously. The lower limit, 30 mm, of the bending resistance range is a value determined from the point of view of sucking a proper amount of silicone oil to be held by the oil holding member. The upper limit, 90 mm, of the bending resistance range is a value determined from the point of view of preventing irregularity of application of oil. The preferred is heat-resisting fiber felt having a bending resistance in the range of 40 to 80 mm, a thickness in the range of 0.4 to 1.0 mm and a density in the range of 150 to 250 kg/m$^3$. Especially, the further preferred bending resistance is in the range of 52 to 68 mm.

A method of providing the heat-resisting fiber felt to the porous oil-holding member is not particularly limited. If the oil application apparatus according to the present invention is shaped like a roller, one to five layers of the felt, preferably two to four layers of the felt may be wound on an outer circumference of a porous round-rod-like oil-holding molded product. If the oil application apparatus according to the present invention is shaped like a pad, one to five layers of the felt, preferably two to four layers of the felt may be attached onto the oil application side of a porous pad-like oil holding molded product.

In the oil application apparatus according to the present invention, the heat-resisting fiber felt and the oil application amount control layer may be bonded to each other by a mixture of an adhesive agent and silicone oil. Hence, the porous oil-holding member and the oil application amount control layer are bonded to each other in a dispersed state as a whole by the curing of the dispersed adhesive agent. As a result, the oil application amount control layer dispersed as a whole secures the oil-flow path for silicone oil on the basis of the dispersed silicone oil. It is important that the mixture is mixed so sufficiently that the adhesive agent and the silicone oil are dispersed into each other. Hence, after the mixture is applied on the whole outer circumferential surface of the heat-resisting fiber felt, the oil application amount control layer is wound by one lap and bonded onto the applied surface. That is, the whole surface of the oil application amount control layer in contact with the whole outer circumferential surface of the heat-resisting fiber felt is bonded by the mixture. The adhesive agent is not particularly limited if the heat-resisting fiber felt and the oil application amount control layer can be bonded to each other by the adhesive agent in the condition that the adhesive agent coexists with silicone oil. Silicone varnish can be used as the adhesive agent. The mixture ratio (SW:SO) of silicone varnish (SW) to silicone oil (SO) in the mixture is in the range of 9:1 to 2:8 (SW:SO=9:1 to 2:8). If the mixture ratio is lower than 9:1, for example, if the mixture ratio is 10:0, the adhesive portion becomes so large and the oil-flow path for silicone oil becomes so small that the amount of application of oil runs short. If the mixture ratio is contrariwise higher than 2:8, for example, if the mixture ratio is 1:9, the adhesive portion becomes so small that the strength of adhesion between the heat-resisting fiber felt and the oil application amount control layer runs short.

A material generally called silicone varnish can be used as the silicone varnish. That is, silicone varnish is obtained from unreacted silicone resin dissolved in a solvent. The silicone resin is silicone rubber having a crosslink density heightened extremely. The silicone varnish contains a great amount of trifunctional or tetrafunctional components and is superior in adhesive power to silicone rubber. Specific examples of the silicone oil mixed with the silicone varnish may include straight-chain methylsilicone oil, branched-chain methylsilicone oil, methylphenylsilicone oil, and denatured silicone oil containing dimethyl groups partially replaced by other organic groups. The viscosity of the silicone oil is generally in the range of 100 to 100,000 cSt, preferably in the range of 5,000 to 30,000 cSt at 25° C.

A typical method of producing the oil application apparatus according to the present invention will be described below. First, a porous oil-holding member is prepared. That is, a waterproof granular organic material for forming pores and a suitable binder, and an inorganic filler for adjusting the amount of inter-fiber voids in the porous oil-holding member, if necessary, are mixed with heat-resisting fiber having a fiber size in the range of about 2 to about 15 $\mu$m at a predetermined mixture ratio. After a suitable amount of water is added to the mixture, the mixture is molded into a desired shape. Thus, the porous oil-holding member is prepared. Examples of the heat-resisting fiber are aluminosilicate fiber, alumina fiber, glass fiber, aramid fiber, etc. Examples of the waterproof granular organic material are granular synthetic resin, wood flour, carbon powder, etc. A specific example of the mixture ratio of the respective materials is 100 parts by weight of the heat-resisting fiber, 100 to 300 parts by weight of the waterproof granular organic material and 2 to 300 parts by weight of the binder.

The molded product thus obtained is dried and hardened under heat. The molded product is further baked at a temperature in the range of about 150 to about 400° C. When the inorganic binder is used in combination, the molded product is baked at a temperature in the range of about 400 to about 1,000° C. As a result, pores remain after the granular organic material is burned out or decomposed and gasified so as to vanish.

By selection of the raw materials, the mixture ratio, the molding condition, etc. in the aforementioned process, a group of pores having a pore size in the range of 0.05 to 2 mm and inter-fiber communicating voids preferably having a void size in the range of 5 to 30 $\mu$m are formed in the baked molded product. Thus, the baked molded product having a total void percentage in the range of 30 to 90%, preferably in the range of about 70 to 85% is obtained. Hence, a great amount of oil can be held while mechanical strength is secured. Moreover, the held oil can be discharged smoothly.

The porous oil-holding member thus obtained is immersed in silicone oil having a low density in the range of 50 to 1,000 cSt, preferably in the range of 50 to 300 cSt at 25° C. As a result, the porous oil-holding member is impregnated with the silicone oil so that a great part of the pores in the holding member are filled with silicone oil. Besides the aforementioned molded product, any fiber or metal porous cylindrical or pad-like molded product may be used as the porous oil-holding member.

Then, heat-resisting fiber felt having a desired thickness, having the same width as that of the porous oil-holding member and having a bending resistance in the range of 30 to 90 mm is provided on the oil application side of the porous oil-holding member. When, for example, the porous oil-holding member is a porous round-rod-like material, one to five layers of the heat-resisting fiber felt, preferably two to four layers of the felt are wound on the outer circumference of the porous oil-holding member. The heat-resisting fiber felt sucks a proper amount of silicone oil from the oil-holding member continuously. Moreover, the heat-resisting fiber felt is suitably elastically deformed to thereby enlarge the contact area between the heat-fixing roller and the oil application roller of the fixing apparatus to eliminate irregularity of application of oil. Moreover, the heat-resisting fiber felt has a function of preventing density irregularity from occurring in a fixed image even in the case where a subject of copying or printing is an OHP sheet.

Finally, the aforementioned porous oil application amount control layer is attached or wound and fixed onto the oil application side of the heat-resisting fiber felt. A method of fixing (providing) the oil application amount control layer is not limited. From the point of view of obtaining an oil application apparatus in which there is no irregularity of application of oil, in which the oil application amount control layer is not displaced or peeled during the operation and in which the oil application amount control layer is bonded to the oil-holding member easily, it is preferable that the porous oil-holding member and the heat-resisting fiber felt are bonded to each other by a mixture of silicone varnish and silicone oil used as the aforementioned adhesive agent. A layer made of polytetrafluoroethylene is preferred as the porous oil application amount control layer. Porous films of polytetrafluoroethylene different in pore size, pore volume, thickness, etc. and having various characteristics are available on the market. Hence, the oil application amount control layer used in the present invention can be obtained easily. Examples of the available article may include tradename "POREFLON" (made by Sumitomo Electric Industries, Ltd.), etc.

A shaft for attaching the oil application apparatus of the present invention obtained by the aforementioned method to a fixing apparatus in a copying machine or a printer can be attached to the oil application apparatus at any stage before or after impregnation with silicone oil.

Figure 2:
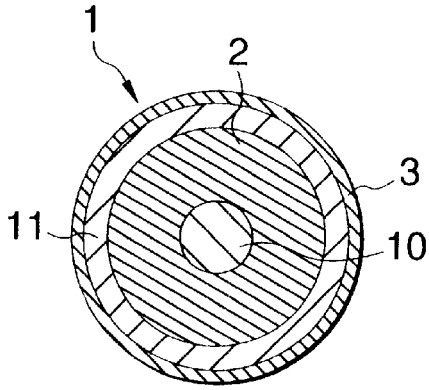
FIG. 2 is a radial sectional view of the oil application roller according to the same carrying-out mode of the present invention.
Figure 3:
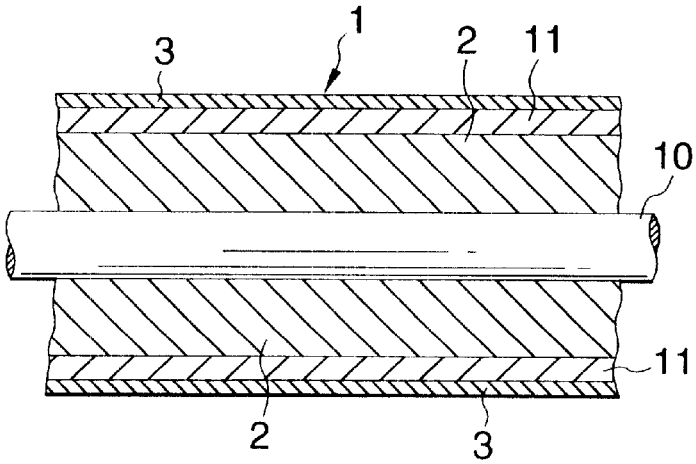
FIG. 3 is an axial sectional view of the oil application roller according to the same carrying-out mode of the present invention.

A schematic structure of the oil application apparatus according to the present invention will be described hereunder with reference to FIGS. 1 through 4. FIG. 1 is a side view showing a state of setting of an oil application roller according to a mode for carrying out the present invention in a fixing apparatus. FIG. 2 is a radial sectional view of the oil application roller according to the carrying-out mode of the present invention. FIG. 3 is an axial sectional view of the oil application roller according to the carrying-out mode of the present invention. In the drawings, the reference numeral 1 designates an oil application roller. The oil application roller 1 has, as basic constituent elements, a porous oil-holding member 2, an oil migration layer 11 provided on the porous oil-holding member 2, and an oil application amount control layer 3 merely wound on the oil migration layer 11 or bonded to the oil migration layer by a mixture of an adhesive agent and silicone oil. The oil application roller 1 is incorporated in a fixing apparatus 4. The fixing apparatus 4 makes a sheet of recording paper 7 pass between a heat-fixing roll 5 and a pressure roll 6 so that toner 8 transferred onto a surface 7*a* of the sheet of recording paper 7 is fixed. In the condition that the oil application roller 1 is made to be in contact with the heat-fixing roll 5, silicone oil which is release oil is applied on the heat-fixing roll 5 so that the toner 8 on the surface 7*a* of the sheet of recording paper 7 is not deposited on the heat-fixing roll 5.

The porous oil-holding member 2 has a shaft 10 attached thereto. The heat-resisting fiber felt 11 is formed on the outer circumference of the oil-holding member 2. The heat-resisting fiber felt 11 is wound on the outer circumference of the oil-holding member 2 and has a role of sucking silicone oil from the oil-holding member 2 and supplying the silicone oil to the oil application amount control layer 3. A drawn polytetrafluoroethylene (PTFE) porous film (hereinafter referred to as PTFE porous film) is used as the oil application amount control layer 3. The oil application amount control layer 3 is merely wound on the heat-resisting fiber felt 11 which is the oil migration layer formed on the outer circumference of the oil-holding member 2. Alternatively, the oil application amount control layer 3 is bonded to the heat-resisting fiber felt 11 by a mixture of an adhesive agent and silicone oil. It is important that the mixture is mixed so sufficiently that the adhesive agent and the silicone oil are dispersed into each other. After the mixture is applied onto the whole outer circumferential surface of the heat-resisting fiber felt 11, the oil application amount control layer 3 is wound by one lap and bonded onto the applied surface.

Figure 4:
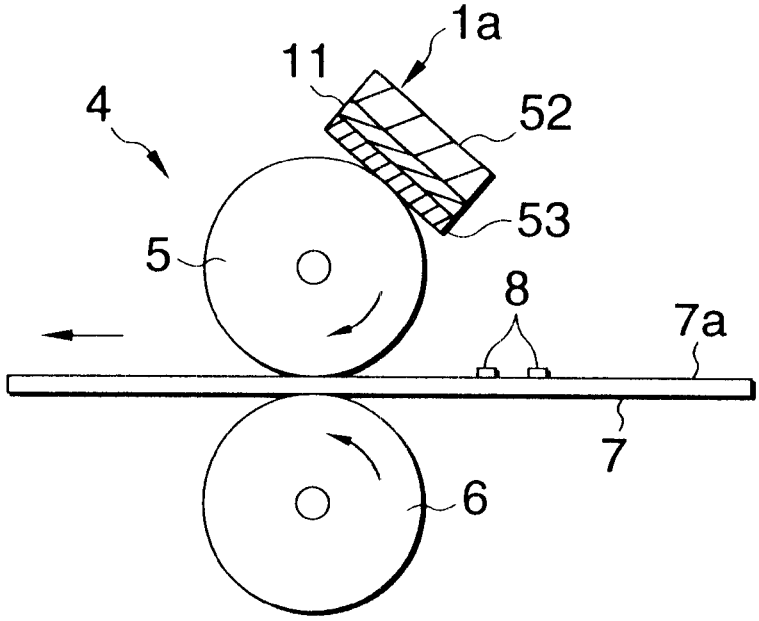
FIG. 4 is a side view showing a state of setting of the oil application roller in a fixing apparatus according to another mode for carrying out the present invention.

FIG. 4 shows another mode for carrying out the present invention. FIG. 4 shows an example in which a pad type apparatus approximately shaped like a flat plate is used as a structure of the oil application apparatus for applying release oil to the heat-fixing roll 5. In this structure, a PTFE porous film 53 is provided, through the heat-resisting fiber felt 11, on a surface of an approximately-flat-plate-like oil-holding member 52 made of a porous material or a material such as felt.

The present invention will be described hereunder more specifically in connection with embodiments thereof.

Embodiment 1

An oil-holding member having a size of 28.4 mm (outer diameter)×8.0 mm (inner diameter)×338.0 mm (length) was produced using aluminosilicate fiber as a main component. The oil-holding member had fine inter-fiber voids and pores with a pore size in the range of 0.1 to 0.3 mm. The total void percentage of the oil-holding member was 78%. The oil-holding member was impregnated with about 120 g of silicone oil having a viscosity of 100 cSt at 25° C. Then, after a shaft was inserted into a hollow portion of the oil-holding member, opposite end portions of the oil-holding member were fixed. Then, heat-resisting aramid fiber felt (tradenamed "NOMEX" and made by Nippon Felt Industrial Co., Ltd.) having a bending resistance of 60 mm, a thickness of 0.7 mm and weight per area of 130 g/m$^2$ was wound by four laps and fixed onto an outer circumferential surface of the oil-holding member. An oil application amount control layer which was a PTFE porous drawn film having a thickness of 50 $\mu$m and a pore size of 0.1 $\mu$m was further wound by one lap and fixed onto an outer circumferential surface of the heat-resisting aramid fiber felt. Thus, an oil application roller was obtained. The oil application roller was evaluated by the following tests (1) and (2) Results were as shown in Table 1.

(1) In the Condition that the oil application roller was attached to an available color printer (color paper feed rate: 4 ppm), a solid single color image of magenta was fixed on a sheet for OHP of an A4-size. After the sheet for OHP was fed out, the sheet was observed as to whether there was irregularity of application of silicone oil on the sheet for OHP or not. Irregularity of application of silicone oil was observed as density or color irregularity in the solid single color image of magenta.

(2) A predetermined number of sheets were printed by the available color printer. The amount of application of oil was calculated on the basis of reduction of the weight of the oil application roller during the printing. A proper amount of application of oil was preliminarily experimentally obtained as an amount of application of oil which is such that toner was not deposited on the fixing roller. "○" shows a proper amount and "small" shows a too small amount of application of oil.

Embodiments 2 and 3

The same process as in Embodiment 1 was performed except that the bending resistance of the heat-resisting aramid fiber felt was changed from 60 mm to 52 mm (Embodiment 2) and to 68 mm (Embodiment 3). Results were as shown in Table 1.

Comparative Example 1

An oil-holding member having a size of 28.4 mm (outer diameter)×8.0 mm (inner diameter)×338.0 mm (length) was produced using aluminosilicate fiber as a main component. The oil-holding member had fine inter-fiber voids, and pores with a pore size of from 0.1 to 0.3 mm. The total void percentage of the oil-holding member was 78%. The oil-holding member was impregnated with about 120 g of silicone oil having a viscosity of 100 cSt at 25° C. Then, after a shaft was inserted into a hollow portion of the oil-holding member, opposite end portions of the oil-holding member were fixed. Then, a 30 mm-wide strip of heat-resisting aramid fiber felt (tradenamed "NOMEX" and made by Nippon Felt Industrial Co., Ltd.) having a bending resistance of 96 mm, a thickness of 2.0 mm and weight per area of 520 g/m$^2$ was wound spirally and fixed onto an outer circumferential surface of the oil-holding member without any gap. Elastic felt having a bending resistance of 60 mm, a thickness of 0.7 mm and weight per area of 130 g/m$^2$ was wound by one lap and fixed onto an outer circumference of the heat-resisting aramid fiber felt. An oil application amount control layer which was a PTFE porous drawn film having a thickness of 50 $\mu$m and a pore size of 0.1 $\mu$m was further wound and fixed onto an outer circumference of the elastic felt. Thus, an oil application roller was obtained. The oil application roller was evaluated by the aforementioned test (1).

Comparative Example 2

An oil-holding member having a size of 28.4 mm (outer diameter)×8.0 mm (inner diameter)×338.0 mm (length) was produced using aluminosilicate fiber as a main component. The oil-holding member had fine inter-fiber voids, and pores with a pore size in the range of 0.1 to 0.3 mm. The total void percentage of the oil-holding member was 78%. The oil-holding member was impregnated with about 120 g of silicone oil having a viscosity of100 cSt at 25° C. Then, after a shaft was inserted into a hollow portion of the oil-holding member, opposite end portions of the oil-holding member were fixed. Then, a 30 mm-wide strip of heat-resisting aramid fiber felt (tradenamed "NOMEX" and made by Nippon Felt Industrial Co., Ltd.) having a bending resistance of 126 mm, a thickness of 2.8 mm and weight per area of 730 g/m$^2$ was wound spirally so as to overlap with itself partially and fixed onto an outer circumferential surface of the oil-holding member. An oil application amount control layer which was a PTFE porous drawn film having a thickness of 50 $\mu$m and a pore size of 0.1 $\mu$m was further wound and fixed onto an outer circumference of the fiber felt. Thus, an oil application roller was obtained. The oil application roller was evaluated by the aforementioned test (1).

Comparative Example 3

The same process as in Embodiment 1 was performed except that the bending resistance of the heat-resisting aramid fiber felt was changed from 60 mm to 28 mm (Comparative Example 3). Results were shown as in Table 1.

TABLE 1

| | Embodiment | | | Comparative Example | | |
|---|---|---|---|---|---|---|
| | 1 | 2 | 3 | 1 | 2 | 3 |
| One-Layer Felt Thickness (mm) | 0.7 | 0.7 | 0.7 | 2.0 | 2.8 | 0.7 |
| One-Layer Felt Bending Resistance (mm) | 60 | 52 | 68 | 96 | 126 | 28 |
| Two-Layer Felt Thickness (mm) | — | — | — | 0.7 | — | — |
| Two-Layer Felt Bending Resistance (mm) | — | — | — | 60 | — | — |
| OHP Oil Application Irregularity | none | none | none | none | present | none |
| Oil Application Amount | ○ | ○ | ○ | ○ | ○ | small |

According to Table 1, irregularity in oil application can be prevented by a simple structure in which one layer of heat-resisting fiber felt having a bending resistance in the range of 30 to 90 mm, preferably in the range of 50 to 70 mm, is provided between the oil-holding member and the oil application amount control layer. In Comparative Example 1, there is no problem upon performance but much labor is required because two kinds of felt are used. It is apparent from Comparative Example 2 that irregularity in oil application is observed when the bending resistance is higher than the upper limit in the range of 30 to 90 mm. It is apparent from Comparative Example 3 that irregularity in oil application is little but the amount of application of oil becomes small when the bending resistance is lower than the lower limit in the range.

According to the present invention, there can be provided an oil application apparatus which has such a simple structure as to be produced easily, which can apply a proper amount of low-viscosity silicone oil just after the beginning of use, in which the amount of wasteful leaking oil during use is so small that there is no risk of application of excessive oil just after the re-start of the paper-passing operation and which can perform such uniform oil application that density irregularity does not occur in a fixed image even in the case where a subject of copying or printing is OHP sheets. Moreover, there can be provided an oil application apparatus in which an oil application amount control layer is prevented from being displaced or peeled and in which the oil application amount control layer is bonded to an oil-holding member easily.

While only certain embodiments of the invention have been specifically described herein, it will be apparent that numerous modifications may be made thereto without departing from the spirit and scope of the invention.

The present invention is based on Japanese Patent Application No. Hei. 11-190225 which is incorporated herein by reference.

What is claimed is:

1. An oil application apparatus comprising:

a porous oil-holding member impregnated with silicone oil;

a heat-resisting fiber felt provided on an oil application side of said porous oil-holding member;

an oil application amount control layer provided on an oil application side of said heat resisting fiber felt;

wherein said heat-resisting fiber felt and said oil application amount control layer are bonded to each other by a mixture of a silicone varnish and silicone oil.

2. The oil application apparatus according to claim 1, wherein said mixture has a mixture ratio (SW:SO) of silicone varnish (SW) to silicone oil (SO) in the range of 9:1 to 2:8.

3. The oil application apparatus according to claim 1, said heat-resisting fiber felt has a bending resistance in the range of 30 to 90 mm.

4. The oil application apparatus according to claim 1, wherein said oil application amount control layer is made of a porous film having a thickness in the range of 15 to 130 $\mu$m, a mean pore size in the range of 0.05 to 3.0 $\mu$m, a volume porosity in the range of 60 to 90%, and a gas permeability in the range of 3 to 1,500 seconds per 100 cc.

5. The oil application apparatus according to claim 1, wherein said oil application amount control layer is made of a porous film having a thickness in the range of 15 to 130 $\mu$m, a mean pore size in the range of 0.05 to 3.0 $\mu$m and a gas permeability in the range of 10,000 to 3,000,000 seconds per 100 cc in the condition that said oil application amount control layer is in a bonded state.

6. The oil application apparatus according to claim 1, wherein said oil application amount control layer is made of a polytetrafluoroethylene porous film.

7. The oil application apparatus according to claim 1, wherein said heat-resisting fiber felt has a bending resistance in the range of 50 to 70 mm.

8. The oil application apparatus according to claim 1, wherein said heat-resisting fiber felt has a bending resistance in the range of 40 to 80 mm, a thickness in the range of 0.4 to 1.0 mm, and a density in the range of 150 to 250 kg/m$^3$.

9. The oil application apparatus according to claim 1, wherein said heat-resisting fiber felt has a bending resistance in the range of 52 to 68 mm, a thickness in the range of 0.4 to 1.0 mm, and a density in the range of 150 to 250 kg/m$^3$.

10. The oil application apparatus according to claim 1, wherein said heat-resisting fiber felt is provided with forming one to five layers of said heat-resisting fiber felt.

11. The oil application apparatus according to claim 1, wherein said heat-resisting fiber felt is provided with forming two to four layers of said heat-resisting fiber felt.

12. An oil application apparatus comprising:

a porous oil-holding member impregnated with silicone oil;

a heat-resisting fiber felt provided on an oil application side of said porous oil-holding member; and an oil application amount control layer provided on an oil application side of said heat-resisting fiber felt, wherein said heat-resisting fiber felt has the substantially same width as that of said porous oil-holding member, and said heat-resisting fiber felt is wound by at least one lap and is fixed onto an outer circumferential surface of said porous oil-holding member and, wherein said heat-resisting fiber felt and said oil application amount control layer are bonded to each other by a mixture of a silicone varnish and silicone oil.

13. The oil application apparatus according to claim 12, wherein said mixture has a mixture ratio (SW:SO) of silicone varnish (SW) to silicone oil (SO) in the range of 9:1 to 2:8.

14. The oil application apparatus according to claim 12, wherein said heat-resisting fiber felt has a bending resistance in the range of 30 to 90 mm.

* * * * *